US005815763A

United States Patent [19]

Todoki

[11] Patent Number: 5,815,763

[45] Date of Patent: Sep. 29, 1998

[54] CONVEYING APPARATUS FOR PHOTOSENSITIVE MATERIAL

[75] Inventor: Kenji Todoki, Wakayama-ken, Japan

[73] Assignee: Noritsu Koki Co., Ltd., Wakayama, Japan

[21] Appl. No.: 822,017

[22] Filed: Mar. 24, 1997

[30] Foreign Application Priority Data

Mar. 28, 1996 [JP] Japan ..... 8-073543

[51] Int. Cl.[6] ..... G03D 3/08

[52] U.S. Cl. ..... 396/618

[58] Field of Search ..... 396/579, 612, 396/620, 575, 618, 622

[56] References Cited

U.S. PATENT DOCUMENTS 3,800,432 4/1974 Miyata et al. ..... 34/620

5,390,428 2/1995 Pummell ..... 34/273

5,669,032 9/1997 Islam et al. ..... 396/579

FOREIGN PATENT DOCUMENTS 60-161359 10/1985 Japan .

*Primary Examiner*—D. Rutledge

*Attorney, Agent, or Firm*—Smith Patent Office

[57] ABSTRACT

A conveying apparatus for photosensitive material is provided with a mesh belt for conveying a developed photosensitive material to a drier section to dry it. The mesh belt has a belt having a thickness of thread within the range of 0.1 mm to 1.0 mm. The mesh size of the mesh belt does not exceed 5 mm. The ratio of the open area of the mesh to the total area of the mesh belt is within the range of 20% to 60%.

5 Claims, 3 Drawing Sheets

CONVEYING APPARATUS FOR PHOTOSENSITIVE MATERIAL

BACKGROUND OF THE INVENTION

1. Field of the Invention

The present invention relates to a conveying apparatus for photosensitive material which is provided with a mesh belt for conveying a developed photosensitive material to a drier section to dry it.

2. Discussion of the Related Art.

A photosensitive material like printing paper is dried after a series of treatments of exposure/printing of the image, developing and washing. During the drying process, the photosensitive material is conveyed with a hot air or wind blowing against it. Japanese Utility Model Laid-Open Publication No. 60-161359 discloses a photosensitive drier section. In the reference, like FIG. 5 of this application, mesh belt 7, made of heat resistant plastic, conveys a printing paper. The reason for using a belt is that it keeps the size and cost down. If a roller conveying system is applied as the alternative, the apparatus would become very large and its cost would also increase. The reason why the belt is meshed is because the mesh allows good ventilation of the hot wind and enough drying of the printing paper.

There are various manufacturing methods for making the belt. A mesh belt, for example, can be formed by warps and wefts. FIG. 6 shows a sectional view of a mesh belt known in the conventional art. Arrow A shows the conveying direction of the printing paper 1 and Arrow B shows a blowing direction of hot wind. The mesh contains warp 2 and weft 3.

SUMMARY OF THE INVENTION

The present invention solves a problem with regard to thread thickness d and mesh size L in conventional mesh drying systems. The problem is especially noticeable when the thread thickness d is too large since a larger area of the printing paper 1 contacts the threads 2 and 3. Further, since these threads 2 and 3, which are heated by the hot wind, cause differences in the drying conditions between the contact and the non-contact areas, the contact area dries faster than the non-contact area resulting in uneven drying. This uneven drying produces a net pattern of the mesh on a printing paper and results in a poor finish quality prints.

Further, for square mesh, the mesh size L is defined as the spacing between the centerlines of adjacent threads as shown in FIG. 6. If the mesh size L is too large it causes a length of contact (illustrated by a length C) between the printing paper 1 and the threads 2, which also leads to uneven drying.

Thus an object of the present invention is to provide a conveying apparatus for photosensitive material with a mesh belt for eliminating these uneven drying conditions.

Another object of the present invention is to provide high quality prints.

A feature of the present invention to achieve the objects mentioned above is that the conveying apparatus for the photosensitive material is provided with a mesh belt for conveying a developed photosensitive material to be dried to a drier section, wherein thickness of thread comprising the mesh belt is within the range of 0.1 mm to 1.0 mm; mesh size of the mesh belt does not exceed 5 mm; and the open area ratio (the ratio of the open area to the total conveying belt area) of the mesh belt is within a range of 20% to 60%, and preferably 30% to 50%.

A thread of over 1 mm thickness brings a greater contact area between a printing paper and the thread heated by the hot wind which leads to uneven drying. A thread of under 0.1 mm thickness would also cause a problem in thread strength.

A mesh size of over 5 mm results in a line contact between the printing paper and the thread and also leads to uneven drying. Therefore, the mesh size must not exceed 5 mm. The mesh size is defined by the side length of a square whose area is equal to an actual area enclosed by a pair of adjacent warp center lines and a pair of adjacent weft center lines. Too small a mesh size causes poor ventilation of the blowing hot wind and leads to a poor drying condition. To meet both requirements of good ventilation and appropriate drying, the open area ratio of the mesh belt, namely the ratio of opening area of the mesh to total conveying belt area, it must fall within the range of 20% to 60%. Furthermore, the open area ratio of the mesh belt within the range of 30% to 50% produces an especially good result.

Thus, proper selection of the thread thickness, the mesh size and the open area ratio of the mesh belt, as described above, prevents uneven drying and enables high quality prints.

It is preferable that the mesh belt is composed of warps parallel to the conveyance direction of the photosensitive material and wefts normal to the conveyance direction. It is preferred that the warp be thicker than the weft, although no problem may occur even if they have the same thickness. It has been found that a combination of warp thickness within the range of 0.5 mm to 1.0 mm and weft thickness within the range of 0.1 mm to 0.5 mm brings good results.

It is necessary that it be difficult for the photosensitive material to slip off the mesh belt so that the mesh belt will convey the photosensitive material without any trouble. In terms of conveying capability, the warps had better be thicker than the wefts. A single thread of weft is preferable since firmness in the direction normal to the conveyance direction is required to keep the mesh belt flat and smooth. Furthermore, the mesh belt is tensioned in the conveyance direction during use. For this reason the warps should be thicker than the wefts. The mesh belt is also required to be flexible in the conveyance direction, so that the preferable warp is a twist yarn because a simple thick warp is not flexible.

BRIEF DESCRIPTION OF THE DRAWINGS

The above and other objects and features of the present invention will be clearly understood from the following description with respect to preferred embodiments thereof when considered in conjunction with the accompanying drawings, wherein the same reference numerals have been used to denote the same or similar parts or elements, and in which.

DETAILED DESCRIPTION OF THE PREFERRED EMBODIMENTS

Figure 1:
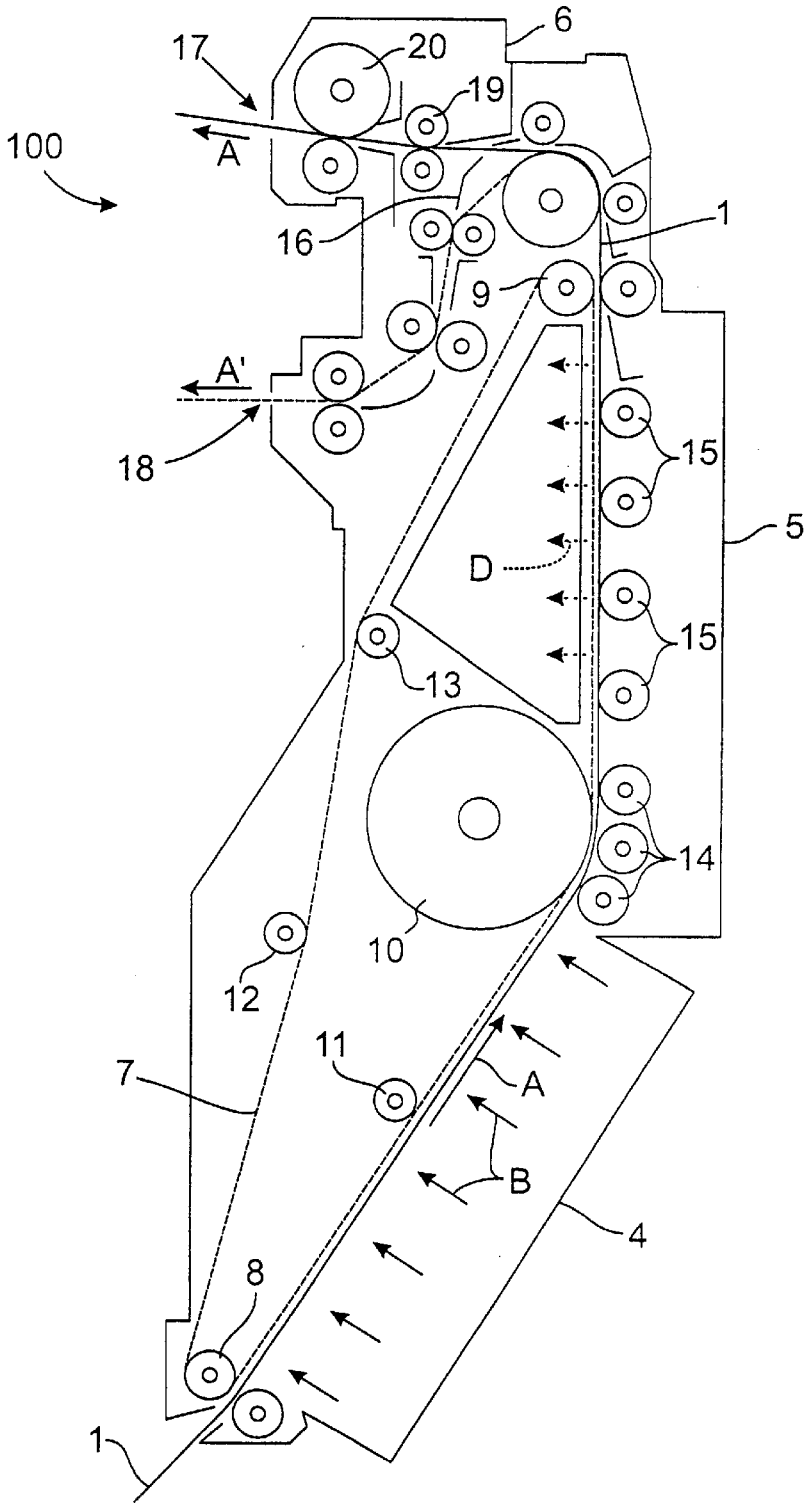
FIG. 1 shows a schematic view of a drier section of a photo printing apparatus according to the present invention.

A preferred embodiment of the conveying apparatus of the present invention will now be described with reference to the drawings, FIG. 1–4. FIG. 1 shows a schematic construction of a drier section and its surroundings for a photo printing apparatus 100.

The photo printing apparatus 100 is provided with a conveying course for a printing paper 1, a drier section 4, an after-heat drier section 5, and a drier rack 6. The printing paper 1 is conveyed in the direction indicated by arrow A in FIG. 1. A mesh belt 7 stretching over the drier section 4 and the after-heat drier section 5 is provided to convey the printing paper 1 along the conveyance course.

Figure 2:
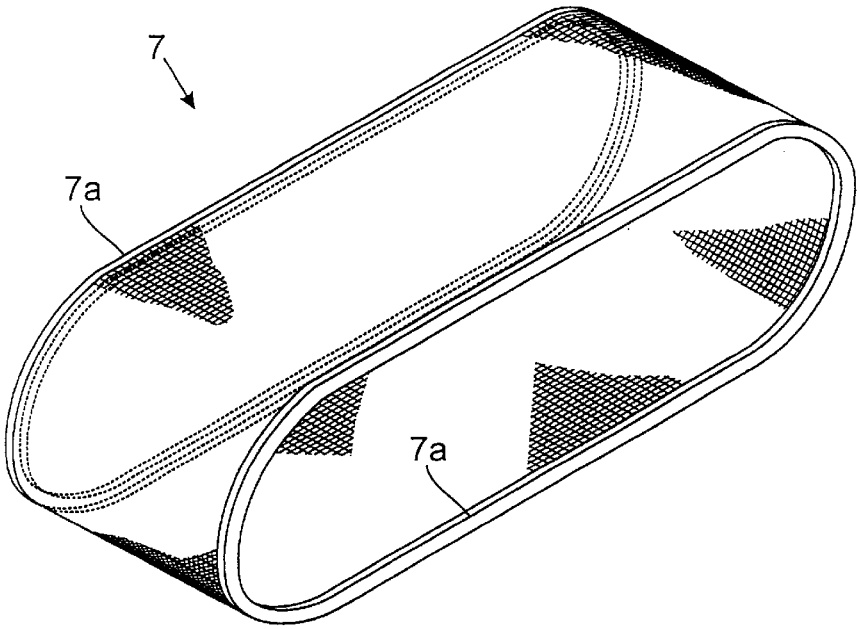
FIG. 2 shows a perspective view of a mesh belt according to the present invention.

A perspective view of the mesh belt 7 is shown in FIG. 2. The mesh belt is driven by a motor, not shown in FIG. 1, with the guidance of two small rollers 8, 9 and a large roller 10. The mesh belt 7 is tensioned by three tension rollers 11, 12, 13. As shown in FIG. 2, both sides of the mesh belt 7 are formed with a thick fringe 7*a*. The thick fringes 7*a* are properly made of flexible plastic strips and are solidly fixed to both sides of the mesh belt in such a way as welding. The fringes 7*a* are engaged with grooves (not shown) formed in the respective rollers so as to prevent the mesh belt from slipping laterally.

In the drier section 4, the hot wind is blown in the direction indicated by arrow B so as to press the printing paper 1 against the mesh belt 7. The maximum ambient temperature in the drier section 4 reaches about 85° C. The after-heat drier section 5 is provided with a group of plural rollers 14 facing the large roller 10 and a group of plural rollers 15 located downstream of the roller group 14. While being dried, the printing paper 1 becomes warped in the direction of its width. Then, the rollers 15 are arranged so as to contact the printing paper 1 at only both side edges of the printing paper 1. Though no hot wind is blown against the printing paper 1 in the after-heat drier section 5, the ambient temperature there is kept elevated. A suction blower (not shown) is provided to keep the printing paper 1 drawn in the direction indicated by arrow D in FIG. 1.

The drier rack 6 is provided with a parting guide 16 which can switch the course of the printing paper 1 so that it can be discharged out of either an upper gate 17 or a lower gate 18 (indicated by arrow A and arrow A' respectively) according to the width of the printing paper 1. A cutter to cut the printing paper into the pieces of specified size is provided at a proper location along the conveyance course before the drier rack 6 or the drier section 4.

In the vicinity of the upper gate 17 of the conveyance course, one-way roller 19 and an acceleration roller 20 are provided. The acceleration roller 20 makes the conveying speed of the printing paper 1 faster at the upper gate 17 than that at other places. The one-way roller 19 is provided to compensate for the difference in conveying speed. In the vicinity of the lower gate 18, a group of plural rollers is also provided.

The mesh belt 7 will be described in detail with reference to FIG. 4 and FIG. 5. The mesh belt 7 comprises warps 2 parallel to the conveyance direction of the printing paper 1 and wefts 3 normal to the conveyance direction of the printing paper 1. As for the weft thickness d1, the one adopted here as an example is 0.2 mm, while the preferred thickness is within the range of 0.1 mm to 1.0 mm and within the range of 0.1 mm to 0.5 mm is more preferable. As for the warp thickness d2, the one used here as an example is 0.8 mm, while the preferred thickness is also within the range of 0.1 mm to 1.0 mm and more specifically within the range of 0.5 mm to 1.0 mm.

The warp is twined by several dozen threads of extremely fine thickness on the order of a few $\mu$m. As for the material of these warp and weft fibers, heat-resistant plastics such as PET (polyester), PEEK (polyether-etherketone), etc. may be selected. PET is particularly useful for its ease of availability, but the selection is not restricted to particular materials as any heat resistant material is allowable.

A preferable combination of warp 2 and weft 3 will now be described. Both the warp 2 and the weft 3 should be thinner if the use was limited to only uniform drying. On the other hand, they both should be thicker if the use is restricted only to conveyance capability (slip resistance of the printing paper 1). Further, the weft 3 must be firm while the warp 2 must be flexible. To meet these requirements, a preferable combination is given by thick twist yarns of warp 2 and a single thin thread of weft 3. As for the thickness range of the warp and the weft, the thread within the thickness range of 0.1 mm to 1.0 mm is practical and without any particular problem. One of the most preferable combinations is given by twist yarns of warp whose thread thickness is within the range of 0.5 mm to 1.0 mm and a single, not-twined and firm thin thread of weft whose thickness is within the range of 0.1 mm to 0.5 mm.

Figure 3:
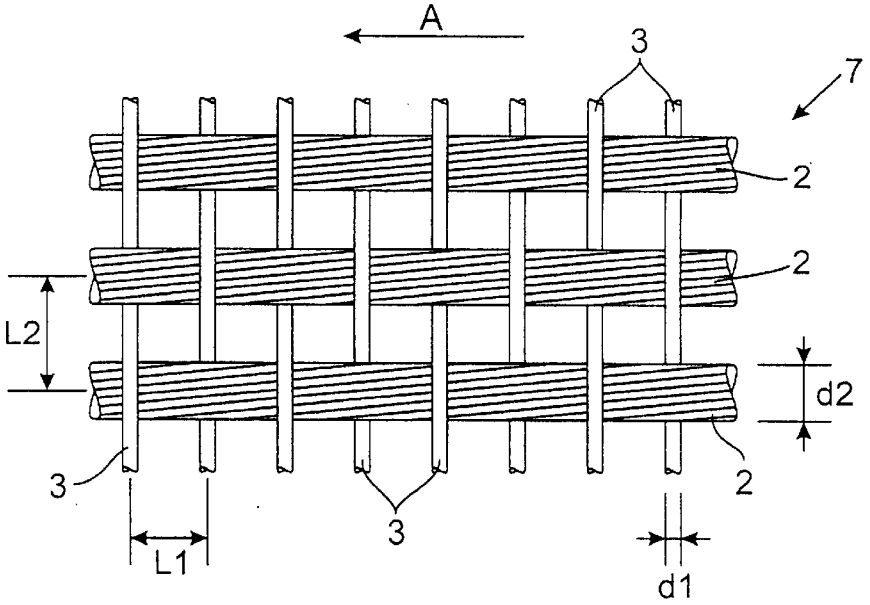
FIG. 3 shows a partially enlarged plan view of a mesh belt according to the present invention.

The mesh size is indicated by the side length of a square whose area is equal to an area enclosed by a pair of adjacent warp center lines and a pair of adjacent weft center lines. The mesh size should not exceed 5 mm since this size does not cause problems. In the embodiment of FIG. 3, the spacing L1 between a pair of adjacent weft center lines is 0.8 mm, the spacing L2 between a pair of adjacent warp center lines is 1.6 mm. For non square mesh where the spacing is different between the adjacent warp center lines and the adjacent weft center lines, the mesh size may be calculated as the square root of (L1×L2), and consequently the mesh size of this example is about 1.1 mm. The open area ratio of the mesh of this embodiment is 37.5% because the weft thickness d1 and the warp thickness d2 are 0.2 mm and 0.8 mm respectively.

Figure 4:
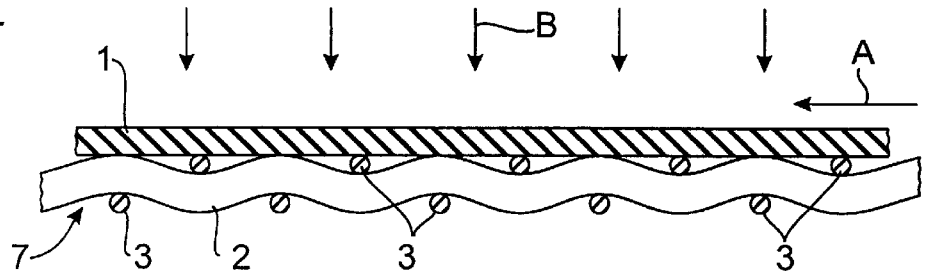
FIG. 4 shows a partially enlarged view of a longitudinal section of a mesh belt according to the present invention.
Figure 5:
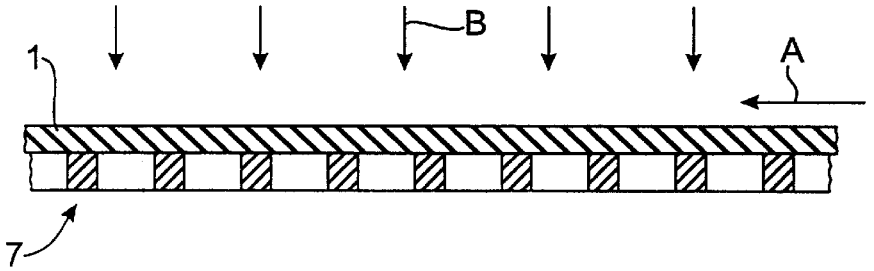
Fig. 5 PRIOR ART
FIG. 5 shows a partially enlarged view of a longitudinal section of a mesh belt of the prior art.
Figure 6:
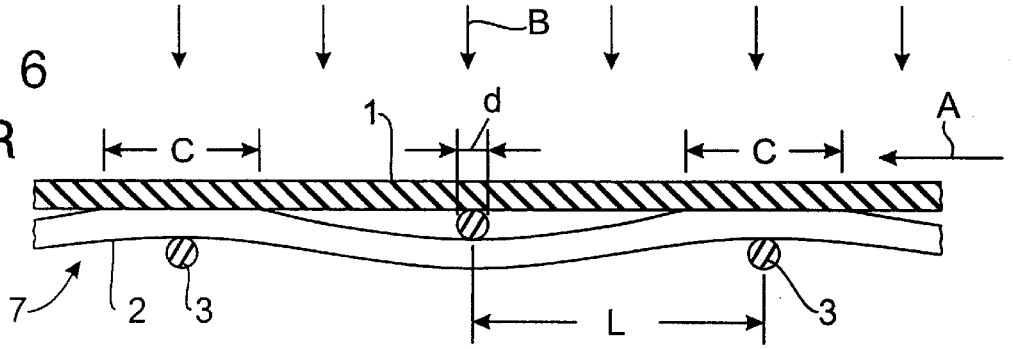
Fig. 6 PRIOR ART
FIG. 6 shows a partially enlarged view of a longitudinal section of another mesh belt according to the prior art.

The mesh belt 7 is shown in a longitudinal sectional view in FIG. 4. Comparing FIG. 4 with FIG. 6, it is easy to understand that thinner warps 2 and thinner weft 3, cause less contact between the printing paper 1 and the mesh belt 7. In FIG. 4, contact area, the printing paper 1 touches the warp 2 or the weft 3 in a way similar to a point-to-point contact due to a smaller mesh size, which consequently eliminates uneven drying. The hot wind blows in the direction shown by an arrow B against the printed surface of the printing paper 1.

After being developed, the printing paper 100 is conveyed to the drier section 4, and dried by a hot wind while being conveyed by the mesh belt 7. Next, while being drawn and kept on the mesh belt 7, the printing paper 1 is conveyed to the after-heat drier section 5 for drying. After passing the after-heat drier section 5, the printing paper 1 exits out of either the upper gate 17 or the lower gate 18 according to the width of the printing paper 1. The combination of a mesh size and thickness of warp 2 and weft 3 is not restricted to those of the embodiment mentioned above. Any combination of thread thickness of warp 2 and weft 3 ranging from 0.1 mm to 1.0 mm, mesh size not exceeding 5 mm, and open area ratio of the mesh ranging from 20% to 60% is allowable.

Needless to say, the present invention is not restricted to a printing paper such as photosensitive material, but is applicable for drying other materials including film.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A conveying apparatus for photosensitive material provided with a mesh belt for conveying a developed photosensitive material to be dried in a drier section, wherein a thickness of threads comprising said mesh belt is within the range of 0.1 mm to 1.0 mm;

a mesh size does not exceed 5 mm; and a ratio of the open area of the mesh to a total area of said mesh belt is within the range of 20% to 60%.

2. A conveying apparatus for photosensitive material in accordance with claim 1, wherein said mesh belt comprises warps parallel to a conveyance direction of the printing paper and wefts normal to the conveyance direction; and said warps are thicker than said wefts.

3. A conveying apparatus for photosensitive material in accordance with claim 2, wherein said warp is a twisted yarn comprising plural threads; and said weft is a single yarn.

4. A conveying apparatus for photosensitive material in accordance with claim 2, wherein the thickness of said warp is within the range of 0.5 mm to 1.0 mm; and the thickness of said weft is within the range of 0.1 mm to 0.5 mm.

5. A conveying apparatus for photosensitive material in accordance with claim 3, wherein the thickness of said warp is within the range of 0.5 mm to 1.0 mm; and the thickness of said weft is within the range of 0.1 mm to 0.5 mm.

* * * * *